US005235703A

United States Patent [19]

Maynard

[11] Patent Number: 5,235,703

[45] Date of Patent: Aug. 17, 1993

[54] SHOCK ABSORBING BODY PROTECTOR

[76] Inventor: Robert Maynard, 315 W. Bradley Ave., El Cajon, Calif. 92020

[21] Appl. No.: 793,577

[22] Filed: Nov. 18, 1991

[51] Int. Cl.[5] ..... A41D 13/00

[52] U.S. Cl. ..... 2/2; 2/45; 2/268; 2/DIG. 3

[58] Field of Search ..... 2/2, DIG. 3, 267, 268, 2/DIG. 10, 92, 2.5, 44, 45, 413; 36/29

[56] References Cited

U.S. PATENT DOCUMENTS

| | | | |
|---|---|---|---|
| 3,664,043 | 5/1972 | Polumbus, Jr. | 36/71 |
| 3,771,170 | 11/1973 | Leon | 2/2 |
| 3,866,241 | 2/1975 | Grant | 2/2 |
| 3,999,220 | 12/1976 | Keltner | 2/2 |
| 4,453,271 | 6/1984 | Donzis | 2/2 |
| 4,467,475 | 8/1984 | Gregory et al. | 2/2 |
| 4,700,403 | 10/1987 | Vacanti | 2/DIG. 3 |
| 4,724,549 | 2/1988 | Herder et al. | 2/411 |
| 4,730,403 | 3/1988 | Walkhoff | 36/93 |
| 4,991,230 | 2/1991 | Vacanti | 2/45 |
| 5,007,111 | 4/1991 | Adams | 2/2 |
| 5,074,765 | 12/1991 | Pekar | 36/29 |

FOREIGN PATENT DOCUMENTS

| | | | |
|---|---|---|---|
| 153082 | 8/1985 | European Pat. Off. | 2/2 |
| 3608585 | 2/1987 | Fed. Rep. of Germany | 2/2 |
| 3530397 | 3/1987 | Fed. Rep. of Germany | 2/2 |
| 2272615 | 1/1974 | France | 2/2 |
| 2177892 | 2/1987 | United Kingdom | 2/2 |

*Primary Examiner*—Clifford D. Crowder
*Assistant Examiner*—Amy Brooke Vanatta
*Attorney, Agent, or Firm*—Brown, Martin, Haller & McClain

[57] ABSTRACT

A body protector for athletes, particularly those engaged in motocross or motorcycle racing, having an outer semirigid plastic shell and an inner layer of air cell material for absorbing the impact of a fall or collision. The air cell material comprises a closed network of cells that are interconnected with channels. The channels slow the air movement away from the impact area, thereby distributing the energy of the impact throughout the cell network. An integral pump allows the wearer to maintain the air cell material at the desired pressure. An inflation indicator allows the wearer to estimate the pressure level of the air cells.

2 Claims, 2 Drawing Sheets

SHOCK ABSORBING BODY PROTECTOR

BACKGROUND OF THE INVENTION

The present invention relates generally to body protectors for athletes engaged in sports such as motorcycle riding and, more specifically, to body protectors having air cells beneath a hard or semirigid outer shell for absorbing impact.

Athletes engaged in off-road motorcycle racing and motocross require protection to avoid injury from flying rock and debris and from abrasions during a fall U.S. Pat. No. 4,467,475 issued to Gregory et al. describes an upper-body protector having a semirigid plastic shell, which includes a chest portion, a back portion, and shoulder epaulets. The parts are connected with webbing to allow relative movement. U.S. Pat. No. 4,694,505 issued to Flosi et al. describes a similar protector having a one-piece shoulder portion connected to a chest portion. Epaulets cover the joint between the shoulder portion and an arm portion.

The hard shell of these body protectors reduces injury to the rider from flying rocks kicked up by motorcycle wheels as well as from sharp protuberances on the motorcycle that might impale the rider during a fall. However, these protectors do not provide adequate impact absorption. Flosi et al. use a thin foam layer to absorb impact. Foam is an economical and well-known material that provides a degree of impact absorption. However, the material has a relatively low spring constant and compresses locally without spreading the impact over a large area. To provide substantial impact protection, a foam layer must be extremely thick, increasing protector weight and bulk. Neither foam nor other padding materials known in the art provide adequate impact protection with a minimal contribution to bulk and weight.

Practitioners in the art have used air cells to provide impact protection. U.S. Pat. No. 4,068,323 issued to Gwon describes a head and body protector for the martial arts having large, strategically located air chambers on the outside of a semirigid shell. A layer of foam is bonded to the inside of the shell adjacent to the wearer. Although the air chambers of Gwon afford protection against the impact of a blunt object, they could easily be ruptured by a sharp object. No provision is made for spreading the impact over a larger number of pressurized cells.

U.S. Pat. No. 4,724,549 issued to Herder et al. describes a helmet having a hard shell and an eggcrate-shaped liner defining a plurality of air cells. The liner is semirigid and therefore provides substantial mechanical resistance to impact; the pneumatic resistance of the air cells provides only a secondary line of protection.

Practitioners in the art have used integral pumps to inflate air chambers in footwear for improving the fit. For example, U.S. Pat. No. 4,730,403 issued to Walkhoff describes a ski boot having a rigid outer shell and air chambers that are inflated using an integral foot-activated pump in the heel of the ski boot.

Practitioners have also used air chambers in athletic footwear such as running shoes and tennis shoes. The purpose of air chambers in footwear uppers is to improve fit and not to provide substantial impact protection. The air chambers in the sole are typically at atmospheric pressure.

Practitioners in the art have not successfully incorporated air cell material for primary impact absorption into a body protector having a semirigid outer shell. Furthermore, the cell materials known in the art cannot be conveniently maintained at a desired pressure. These problems and deficiencies are clearly felt in the art and are solved by the present invention in the manner described below.

SUMMARY OF THE INVENTION

The present invention is a protector for covering one or more parts of the body of an athlete engaged in sports such as cross-country motorcycle racing, motocross, off-road bicycle racing, and boat racing. The body protector comprises a plurality of air cells covered with a shell made of a suitable semirigid plastic material. An inner liner protects the wearer against abrasion from contact with the air cell material. The body protector may include a manually-operable pump, which allows the wearer to maintain proper inflation of the air cells.

In motorcycle racing, for example, the outer shell deflects rocks and debris and protects the wearer against abrasions and puncture injuries during a fall or collision. The air cells reduce the possibility of internal injury to the rider by absorbing the impact energy of a collision or fall. In addition to resisting penetration of foreign objects, the semirigid shell distributes impact energy over a number of air cells by force transfer in bending.

To provide substantial protection from impact through pneumatic resistance alone, the air cells may be pressurized to a level greater than that of the atmosphere. However, the use of such pressurized cells in body protectors has not been successful in the prior art because the pressure gradually decreases over time as air escapes through the walls of the cell material. The problem is exacerbated when air cells are inflated to pressures greater than that of the atmosphere or when subjected to repeated impacts. No material is completely impervious to this effect and those that are highly resistant to such leakage may be unsuitably heavy for use in body protectors.

A wearer may maintain the cells at the desired pressure using a pump that he periodically connects to a valve on the body protector before using it. However, such maintenance is inconvenient and may encourage the unsafe practice of using an underinflated protector. The present invention may include an integral pump to overcome this problem.

The pump is manually operable and mounted at a location on the body protector where it is easily accessible to the wearer. The wearer can use the pump to increase the air pressure in the body protector at any time. The pump should be easy to use, unobtrusive when mounted on the body protector, and mechanically simple to maximize manufacturing economy. Such a pump may comprise a valve assembly connected to a hollow hemisphere of a suitable resilient material such as rubber that protrudes from the shell. Depressing the hemisphere effects a stroke of the pump, injecting air into the cell network. The wearer can inflate the air cells by repetitively depressing and releasing the hemisphere using a finger.

A network of interconnected air cells may be used in combination with such a shell to further improve impact energy distribution. A network of interconnected air cells improves impact energy absorption by distributing it over an area of the protector larger than the immediate area of impact. The network comprises a plurality of cells interconnected by narrow channels or openings in the walls of adjacent cells. When this material experiences an impact, air is forced from the cells in the immediate area of the impact into adjacent cells. The channels prevent rapid evacuation of the cell because they are small in comparison to the cell volume. The channels also inhibit bursting of the cells in the immediate area of a forceful impact because localized pressures may be dissipated to adjacent cells. Furthermore, an impact does not completely collapse the cells in the immediate impact area if the cell network pressure is maintained at a suitable level.

The present invention may also include a suitable pressure indicator for providing an indication of the inflation pressure to the wearer. The wearer may experience difficulty in judging the pressure level because the outer shell inhibits tactile access to the air cell material. The pressure indicator should be mounted on the body protector in a convenient location accessible to the wearer. The pump does not provide the wearer with tactile feedback of inflation level because a valve prevents the air cell network pressure from being exerted against the pump hemisphere. Although a conventional gauge or meter may be used, the pressure indicator may comprise a hollow resilient hemisphere similar in appearance to that of the pump. The air cell network pressure is exerted against the inside of the hemisphere, enabling the wearer to quickly estimate the inflation pressure from the rigidity of the hemisphere. Such a pressure indicator provides an economical means for quickly ascertaining the inflation level.

In addition to the pump, the present invention may comprise a suitable external inflation valve for inflating the air cell network using an external pump. It may be desirable to use an external pump or other source of compressed air to inflate a completely evacuated air cell network because it may be time-consuming to inflate it using the integral pump. The inflation valve may be of the type having an orifice for receiving a hollow inflation needle. Pumps having inflation needles are well-known and are commonly used to inflate basketballs and the like.

The present invention may be incorporated into all body part protectors such as a chest protectors, back protectors, knee/shin guards, elbow/arm guards, kidney belts, and shoulder protectors or "epaulets."

BRIEF DESCRIPTION OF THE DRAWINGS

The foregoing, together with other features and advantages of the present invention will become more apparent when referring to the following detailed description in which reference numerals refer to the drawings in which.

DESCRIPTION OF THE PREFERRED EMBODIMENTS

Figure 1:
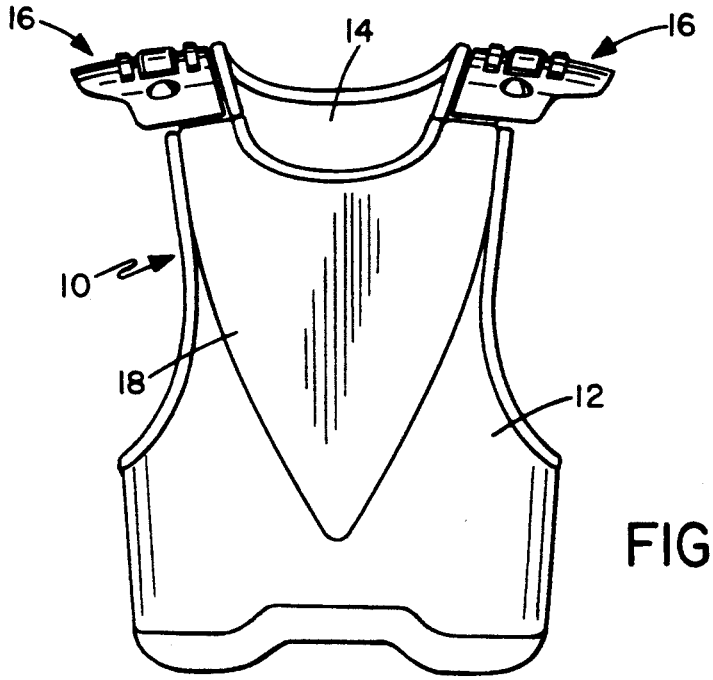
FIG. 1 is a front view of a typical upper body protector having shoulder epaulets.

In FIG. 1, a body protector 10 for protecting the upper body of a wearer (not shown) comprises a ventral portion 12 and a dorsal portion 14. Portions 12 and 14 are connected to two epaulets 16 above the shoulder area of the wearer. The V-shaped region 18 of ventral portion 12 may comprise a reinforced mesh for providing ventilation.

Figure 2:
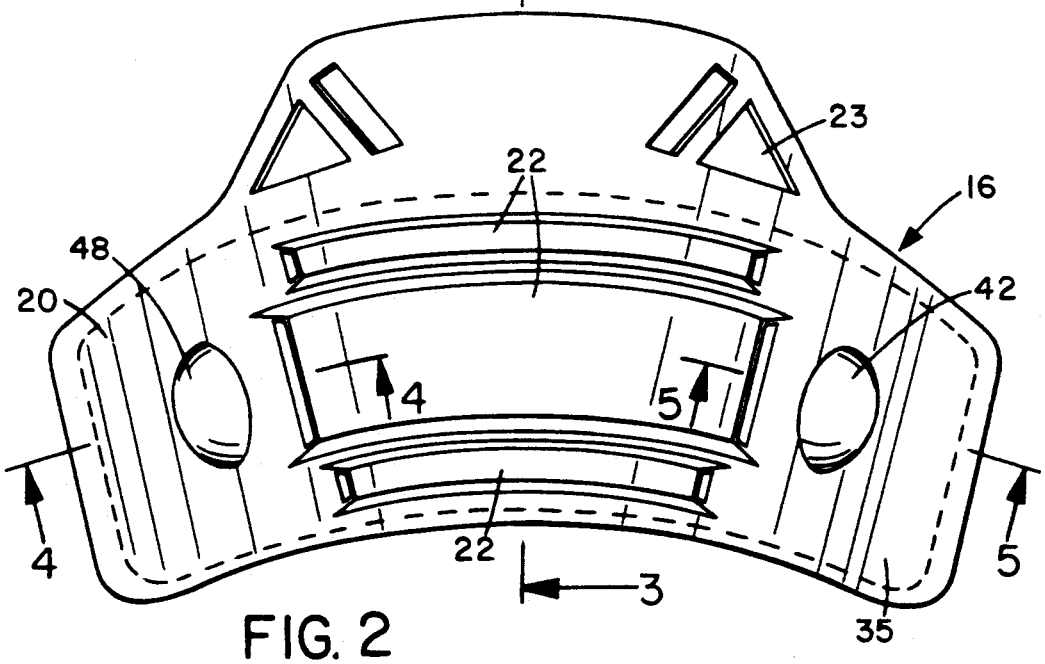
FIG. 2 is a top plan view of an epaulet.
Figure 3:
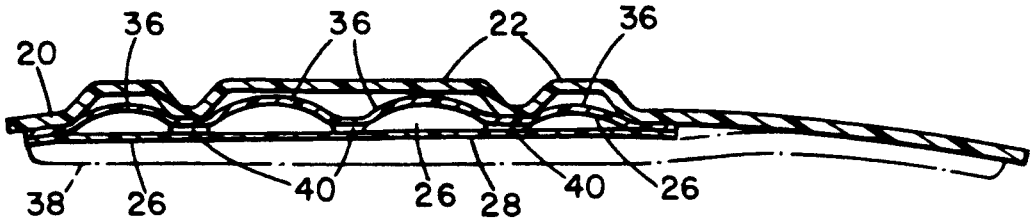
FIG. 3 is an enlarged sectional view taken along line 3—3 of FIG. 2.

Epaulet 16, shown in FIG. 2, comprises an outer shell 20 made of high-density polyurethane. Shell 20 may have one or more ribs 22 for reinforcement and ventilation. It may also have one or more openings 23 for ventilation and reduction of weight.

Figure 6:
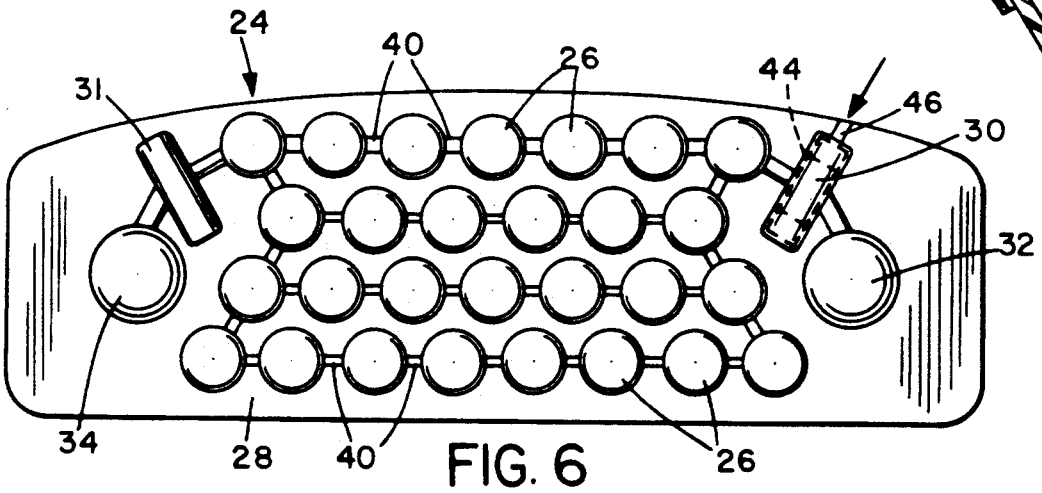
FIG. 6 is a plan view of the inside layer of the epaulet, showing the air cells, pump, and pressure indicator.

An air cell layer 24, disposed between shell 20 and the wearer, is shown in FIG. 6. Layer 24 is a commercially-available product, comprising a plurality of interconnected air cells 26 formed on the top of a substrate 28. Layer 24 may also comprise a valve chamber 30, a pump chamber 32, and a pressure indicator chamber 34. Layer 24, which is at least 0.25 inches in thickness, is disposed within the region 35 defined by the dashed line in FIG. 2.

Air cells 26 have walls 36 that are substantially hemispherical in shape when fully inflated. Walls 36 are preferably formed of high-density polyurethane between 0.5 and 0.9 millimeters thick. Although walls 36 of air cells 26 are shown adjacent to the inside surface of shell 20, it is understood that layer 24 may be reversed in other embodiments; substrate 28 being disposed adjacent to the inside surface of shell 20. An inner liner 38 protects the wearer against abrasion from contact with layer 24.

Each cell 26 is pneumatically connected to an adjacent cell by one or more channels 40. Although channels 40 are shown as tube-like structures, they may have any shape. In certain embodiments having walls 36 of adjacent air cells 26 in contact with one another, channels 40 may simply comprise openings in walls 36.

When a portion of shell 20 over one or more air cells 26 experiences an impact, air is forced from those air cells through channels 40 and into adjacent air cells. The diameter of channels 40 is small in comparison to the volume of each air cell 26, thereby reducing the rate of dispersion of air from the impact area. Each air cell 26 in the impact area acts in the manner of a piston, using the impact energy to compress the air and force it into adjacent air cells 26. Channels 40 also inhibit bursting of air cells 26 should they experience an extremely forceful impact. Air cells 26 are inflated to a pressure level above atmospheric of between five and fifteen pounds per-square-inch (PSI).

The wearer may inflate air cells 26 by depressing a pump bulb 42 that covers pump chamber 32 and protrudes through an opening in shell 20. Pump bulb 42 is substantially hemispherical and made of a suitable resilient material such as rubber or plastic. Depressing pump bulb 42 injects air into air cells 26 through a valve assembly 44 disposed within valve chamber 30. Releasing pump bulb 42 draws air from an orifice 46 into pump chamber 32 through valve assembly 44. Pump bulb 42 additionally shields valve assembly 44 against dirt and moisture intrusion. Air cells 26 may thus be inflated by repeatedly depressing and releasing pump bulb 42. An external pump (not shown) such as those commonly used to inflate basketballs may also be used to inflate air cells 26. The needle of such a pump is inserted into orifice 46 and is received by valve assembly 44.

Figure 4:
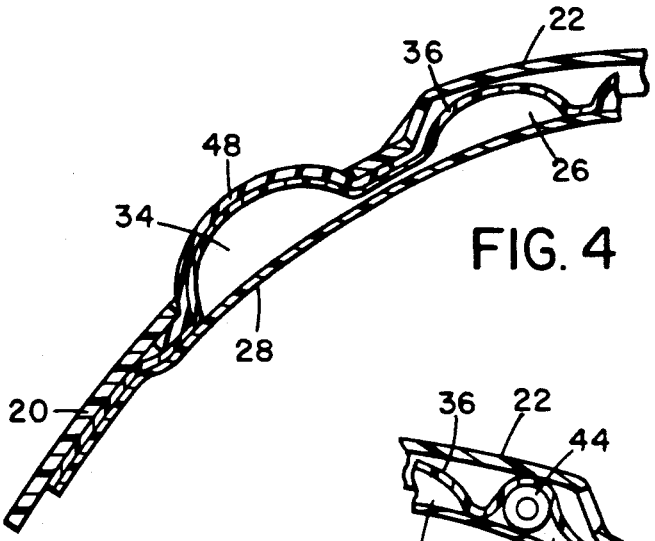
FIG. 4 is an enlarged sectional view taken along line 4—4 of FIG. 2.
Figure 5:
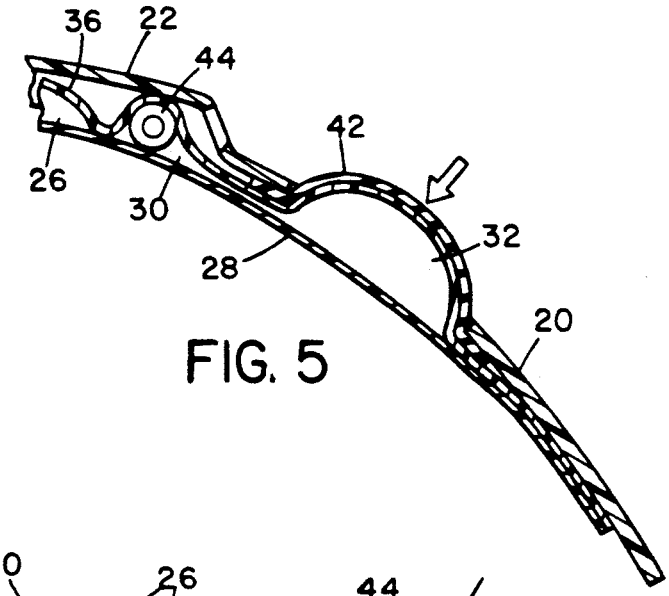
FIG. 5 is an enlarged sectional view taken along line 5—5 of FIG. 2.

The wearer cannot easily discover whether air cells 26 are properly inflated because shell 20 inhibits tactile access to air cells 26. Furthermore, inner liner 38 or apparel beneath inner liner 38 on the body of the wearer may inhibit tactile access to air cells 26 from the inside of epaulet 16. As shown in FIG. 4 a pressure indicator bulb 48 covers pressure indicator chamber 34 and protrudes through an opening in shell 20, allowing the wearer to estimate inflation pressure simply by feeling pressure indicator bulb 48. A wearer may use bulb 48 to conveniently and quickly check the inflation pressure even while wearing heavy gloves.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. An epaulet for protecting the shoulder area of a wearer's body, comprising:

a semirigid shell having an arcuate shape for covering said shoulder area, said shell having an inside surface and an outside surface;

a plurality of air cells between said inside surface of said shell and said shoulder area for retaining a volume of air having a pressure, each air cell of said plurality in pneumatic communication with at least one other air cell of said plurality, said semirigid shell covering each air cell of said plurality of air cells;

a hand-operable pump connected to said plurality of air cells for inflating said plurality of air cells, said pump having a substantially hemispherical resilient bulb portion protruding above said outside surface of said semirigid shell and a substantially flat portion disposed below said inside surface of said semirigid shell and adjacent said plurality of air cells;

a pressure indicator for providing an indication of said air pressure of said volume, said pressure indicator having a resilient bulb portion protruding above said outside surface of said semirigid shell; and said shell having a longitudinal rib having first and second ends, said resilient bulb portion of said pump disposed adjacent to said first end of said rib and said resilient bulb portion of said pressure indicator disposed adjacent said second end of said rib for protecting each said resilient bulb portion.

2. An epaulet as described in claim 1, further comprising an inner liner between said plurality of air cells and said area of said body.

* * * * *